US010049811B2

(12) United States Patent
Huang et al.

(10) Patent No.: US 10,049,811 B2
(45) Date of Patent: Aug. 14, 2018

(54) MULTI-PHASE AUTOTRANSFORMER

(71) Applicant: The Boeing Company, Chicago, IL (US)

(72) Inventors: Jian Huang, Everett, WA (US); Ernest H. Kanning, Everett, WA (US); Alan T. Bernier, Woodinville, WA (US)

(73) Assignee: The Boeing Company, Chicago, IL (US)

( * ) Notice: Subject to any disclaimer, the term of this patent is extended or adjusted under 35 U.S.C. 154(b) by 155 days.

(21) Appl. No.: 14/663,798

(22) Filed: Mar. 20, 2015

(65) Prior Publication Data

US 2016/0276099 A1 Sep. 22, 2016

(51) Int. Cl.
*H01F 30/12* (2006.01)
*H01F 30/02* (2006.01)

(52) U.S. Cl.
CPC ..... *H01F 30/12* (2013.01); *H01F 30/02* (2013.01)

(58) Field of Classification Search
CPC ..... H01F 5/00; H01F 27/28
USPC ..... 336/5
See application file for complete search history.

(56) References Cited

U.S. PATENT DOCUMENTS

| | | | | |
|---|---|---|---|---|
| 3,753,189 | A | 8/1973 | Allen | |
| 3,816,805 | A * | 6/1974 | Terry | H02J 7/1423 307/16 |
| 3,932,804 | A | 1/1976 | Allen | |
| 4,611,190 | A | 9/1986 | Montague | |
| 4,922,400 | A | 5/1990 | Cook | |
| 5,050,058 | A | 9/1991 | April et al. | |
| 5,055,992 | A | 10/1991 | Cook | |
| 5,574,418 | A * | 11/1996 | Matsumura | H01F 30/12 336/155 |
| 6,101,113 | A | 8/2000 | Paice | |
| 7,772,953 | B2 | 8/2010 | Huang et al. | |
| 7,772,954 | B2 | 8/2010 | Huang et al. | |
| 2010/0148900 | A1 * | 6/2010 | Huang | H01F 30/14 336/12 |
| 2011/0148556 | A1 * | 6/2011 | Park | H01F 30/02 336/12 |
| 2012/0013428 | A1 | 1/2012 | Hoevenaars | |

(Continued)

FOREIGN PATENT DOCUMENTS

| | | | |
|---|---|---|---|
| FR | 2765725 | A1 | 1/1999 |
| FR | 2896333 | A1 | 7/2007 |
| GB | 2128422 | A | 4/1984 |

(Continued)

OTHER PUBLICATIONS

Extended European Search Report, dated Aug. 17, 2016, regarding Application No. 16161481.3, 10 pages.

(Continued)

*Primary Examiner* — Tsz Chan
(74) *Attorney, Agent, or Firm* — Yee & Associates, P.C.

(57) ABSTRACT

A transformer comprising a core and a plurality of conductor lines. Each conductor line in the plurality of conductor lines comprises at least three windings wound around the core such that a phase voltage at an output connection point associated with a corresponding conductor line of the plurality of conductor lines is substantially a selected percentage of a line voltage for the corresponding conductor line and such that harmonic currents are reduced to within selected tolerances.

29 Claims, 10 Drawing Sheets

(56) References Cited

U.S. PATENT DOCUMENTS

2013/0170257 A1 7/2013 Ganev et al.

FOREIGN PATENT DOCUMENTS

| | | | | | |
|---|---|---|---|---|---|
| KR | 20130047703 | A | * | 5/2013 | |
| KR | 20140120084 | A | | 10/2014 | |
| WO | WO 2009038336 | A2 | * | 3/2009 | ..... H01F 27/385 |
| WO | WO 2010032957 | A2 | | 3/2010 | |

OTHER PUBLICATIONS

European Patent Office Examination Report, dated Jan. 18, 2018, regarding Application No. 16161481.3, 4 pages.

* cited by examiner

MULTI-PHASE AUTOTRANSFORMER

BACKGROUND INFORMATION

1. Field

The present disclosure relates generally to transformers and, in particular, to autotransformers. Still more particularly, the present disclosure relates to a multi-phase autotransformer having a configuration that improves harmonic mitigation.

2. Background

Some devices are powered using direct current (DC) power, while other devices are powered using alternating current (AC) power. In certain applications, power sources that provide alternating current power are used to supply power to electrical components that require direct current power. Typically, in these applications, alternating current power is converted into direct current power using a transformer.

As one illustrative example, a power generation system for an aircraft may include power sources that are used to supply power to electrical components onboard an aircraft. These power sources are typically alternating current power sources. The power sources may include, for example, without limitation, any number of alternators, generators, auxiliary power units, engines, other types of power supplies, or combination thereof. The alternating current power provided by these power sources may be converted into direct current power that may be sent to any number of electrical components onboard the aircraft. The electrical components may include, for example, without limitation, a locking mechanism, a motor, a computer system, a light system, an environmental system, or some other type of device or system on the aircraft.

However, converting alternating current power into direct current power may lead to undesired harmonics, which may, in turn, lead to undesired harmonic distortion of the power generation system, power distribution system, or both. Harmonics are currents and voltages at frequencies that are multiples of the fundamental power frequency. Reducing harmonics, and thereby, harmonic distortion, may reduce peak currents, overheating, and other undesired effects in electrical power systems.

Some currently available multi-phase transformers, including zigzag transformers, may be used in electrical power systems to reduce harmonic currents, and thereby, harmonic distortion. However, the level of harmonic mitigation provided by these currently available transformers may not reduce harmonic currents to within selected tolerances. Consequently, additional electrical devices, such as filters, may need to be used in the electrical power systems. However, these additional electrical devices may increase the overall weight of the electrical power systems more than desired. Therefore, it would be desirable to have a method and apparatus that take into account at least some of the issues discussed above, as well as other possible issues.

SUMMARY

In one illustrative embodiment, a transformer comprises a core and a plurality of conductor lines. Each conductor line in the plurality of conductor lines comprises at least three windings wound around the core such that a phase voltage at an output connection point associated with a corresponding conductor line of the plurality of conductor lines is substantially a selected percentage of a line voltage for the corresponding conductor line and such that harmonic currents are reduced to within selected tolerances.

In another illustrative embodiment, a transformer comprises a core, a first conductor line, a second conductor line, and a third conductor line. The first conductor line comprises a first plurality of windings that includes at least two windings of at least two phases between a neutral point and a first output connection point associated with the first conductor line. The second conductor line comprises a second plurality of windings that includes at least two windings of at least two phases between the neutral point and a second output connection point associated with the second conductor line. The third conductor line comprises a third plurality of windings that includes at least two windings of at least two phases between the neutral point and the second output connection point associated with the third conductor line.

In yet another illustrative embodiment, a transformer comprises a core, a first conductor line, a second conductor line, and a third conductor line. The first conductor line comprises a first plurality of windings that includes at least three windings. The second conductor line comprises a second plurality of windings that includes at least three windings. The third conductor line comprises a third plurality of windings that includes at least three windings. The first plurality of windings, the second plurality of windings, and the third plurality of windings are wound around the core such that a phase of each winding of the first conductor line, the second conductor line, and the third conductor line is consistent with a wye line configuration.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account different considerations. For example, the illustrative embodiments recognize and take into account that it may be desirable to have a transformer with a configuration that improves harmonic mitigation.

Further, the illustrative embodiments recognize and take into account that it may be desirable to have a transformer with a configuration that reduces undesired effects caused by electromagnetic interference, while improving harmonic mitigation. In this manner, the overall quality of the power generated by an electrical power system using this type of transformer may be improved. Thus, the illustrative embodiments provide a multi-phase autotransformer that improves harmonic mitigation, while also reducing undesired electromagnetic interference (EMI) effects.

Figure 1:
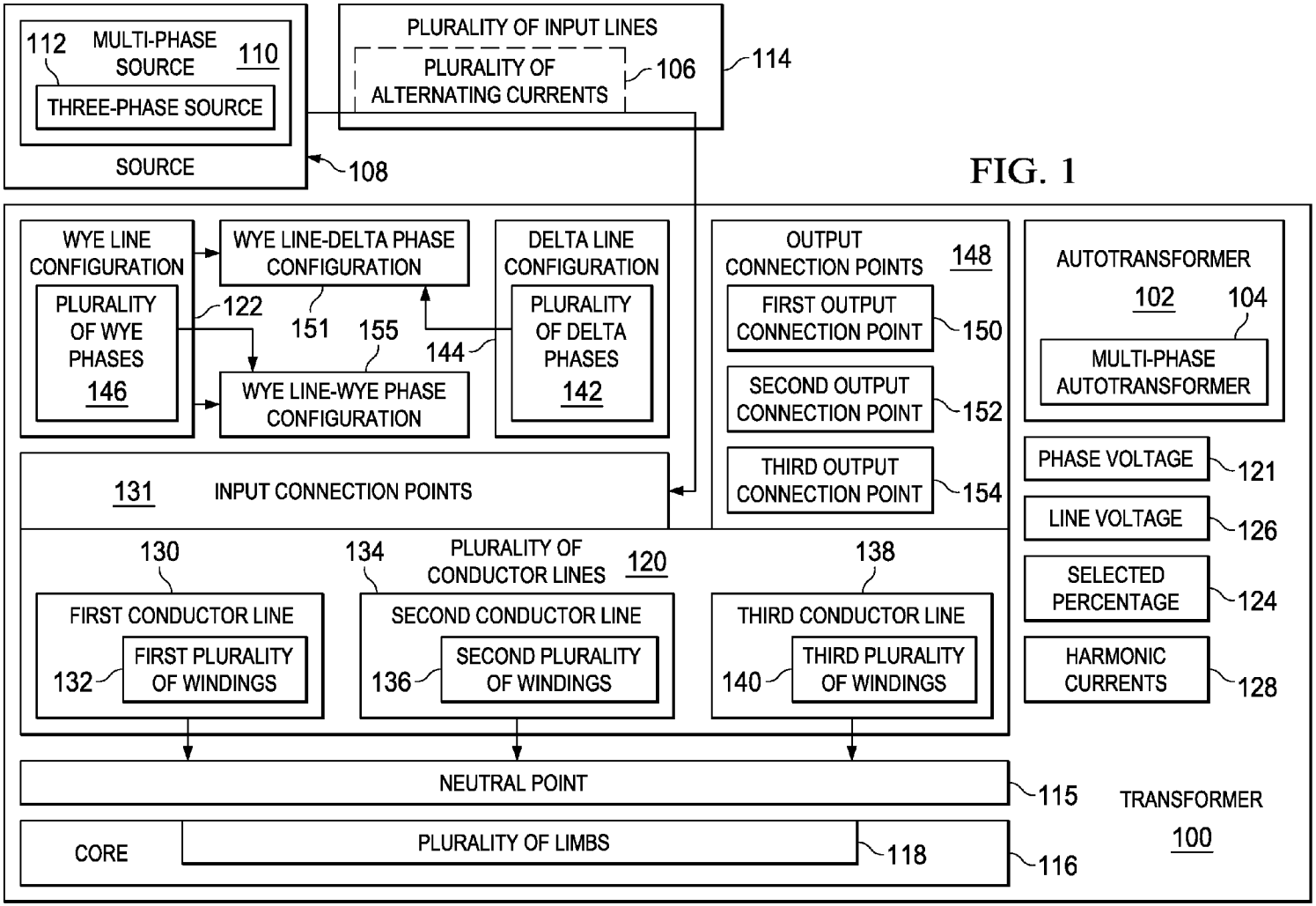
FIG. 1 is an illustration of a transformer in the form of a block diagram in accordance with an illustrative embodiment.

Referring now to the figures and, in particular, with reference to FIG. 1, an illustration of a transformer is depicted in the form of a block diagram in accordance with an illustrative embodiment. In this illustrative example, transformer 100 may be used for converting alternating current power to direct current power. In particular, transformer 100 is used to change the voltage level of alternating current power received at transformer 100 such that the new voltage level may be suitable for conversion into direct current power.

In this illustrative example, transformer 100 takes the form of autotransformer 102. In particular, autotransformer 102 may take the form of multi-phase autotransformer 104. In other illustrative examples, transformer 100 may take the form of an isolation transformer.

Transformer 100 is configured to receive plurality of alternating currents 106 from source 108. Source 108 may be an alternating current power supply. In other words, source 108 is configured to provide alternating current power in the form of alternating currents, alternating voltages, or both.

As used herein, alternating voltage is voltage that reverses direction periodically. The waveform of alternating voltage is typically an alternating waveform such as, for example, without limitation, a sine wave. Conversely, direct voltage is voltage that is unidirectional. As used herein, alternating voltage may be measured at a connection point, across a capacitor, or along a conductor line with respect to a neutral point or ground.

Source 108 may take a number of different forms, depending on the implementation. For example, source 108 may take the form of multi-phase source 110. Multi-phase source 110 provides multiple alternating currents having different phases. As one illustrative example, multi-phase source 110 may take the form of three-phase source 112 that provides three alternating currents having three different phases. These three alternating currents may be, for example, offset in phase by about 120 degrees relative to each other. In this manner, three-phase source 112 provides a three-phase alternating current input for transformer 100.

Transformer 100 receives plurality of alternating currents 106 from source 108 through plurality of input lines 114. As used herein, a "line," such as one of plurality of input lines 114, may be comprised of any number of electrical lines, wires, or leads configured to carry electrical current. The alternating voltage carried along any one of plurality of input lines 114 may be measured with respect to a neutral point or ground.

When source 108 takes the form of three-phase source 112, plurality of input lines 114 includes three input lines, each carrying alternating current of a different phase. Each of plurality of input lines 114 may be comprised of a conductive material. The conductive material may take the form of, for example, without limitation, aluminum, copper, a metal alloy, some other type of conductive material, or some combination thereof.

As depicted, transformer 100 includes core 116 having plurality of limbs 118 and plurality of conductor lines 120. Each of plurality of limbs 118 may be an elongated portion of core 116. In this manner, plurality of limbs 118 may be considered unitary with core 116. As used herein, a first item that is "unitary" with a second item may be considered part of the second item.

In these illustrative examples, plurality of limbs 118 includes as many limbs as there are alternating currents in plurality of alternating currents 106. For example, when source 108 takes the form of three-phase source 112, plurality of limbs 118 includes three limbs. Plurality of limbs 118 may also be referred to as a plurality of legs in some illustrative examples.

Core 116 may be comprised of one or more different types of materials, depending on the implementation. For example, core 116 may be comprised of steel, iron, a metal alloy, some other type of ferromagnetic metal, or a combination thereof.

Transformer 100 has wye line configuration 122. In these illustrative examples, a "line configuration" refers to the configuration of plurality of conductor lines 120, and thereby the windings of plurality of conductor lines 120, with respect to each other and core 116. In one illustrative example, plurality of conductor lines 120 are wound around plurality of limbs 118 of core 116 and connected to each other at neutral point 115 to form wye line configuration 122.

With wye line configuration 122, one end of each of plurality of conductor lines 120 is connected to neutral point 115, while the other end is connected to a corresponding one of plurality of input lines 114. Input connection points 131 are the connection points at which plurality of input lines 114 connect to plurality of conductor lines 120.

In this illustrative example, the connecting of plurality of conductor lines 120 configured for receiving alternating currents of different phases to each other forms neutral point 115 where plurality of conductor lines 120 meet. However, in other illustrative examples, neutral point 115 may be grounded.

Each of plurality of conductor lines 120 may include one or more windings and may be comprised of a conductive material. Each of these windings may take the form of a coil or a portion of a coil having one or more turns. The conductive material may take the form of, for example, without limitation, aluminum, copper, a metal alloy, some other type of conductive material, or some combination thereof.

In these illustrative examples, each conductor line in plurality of conductor lines 120 includes at least three windings wound around core 116. In particular, the at least three windings of each of plurality of conductor lines 120 may be wound around core 116 such that phase voltage 121 across these windings at an output connection point associated with a corresponding conductor line of plurality of conductor lines 120 is substantially selected percentage 124 of line voltage 126 for the corresponding conductor line.

Selected percentage 124 may be a percentage that is less than about 100 percent. For example, selected percentage 124 may be within a range between about 1 percent and about 99 percent. Depending on the implementation, selected percentage 124 may be a percentage between about 1.0 percent and about 57.5 percent or a percentage between about 58.0 percent and about 99.0 percent. In this manner, plurality of conductor lines 120 may be wound around core 116 with a select number of turns in each of the at least three windings to achieve a desired ratio of line voltage 126 to phase voltage 121 that is less than 1:1.

Further, the at least three windings of each of plurality of conductor lines 120 may be wound around core 116 such that harmonic currents 128 are reduced to within selected tolerances. In other words, the at least three windings of each of plurality of conductor lines 120 may be wound around core 116 to improve harmonic mitigation. Harmonic mitigation may increase as the number of windings included in each of plurality of conductor lines 120 increases.

Plurality of conductor lines 120 may be implemented in a number of different ways. The at least three windings of each of plurality of conductor lines 120 may be wound around at least two of plurality of limbs 118 of core 116.

In one illustrative example, plurality of conductor lines 120 includes first conductor line 130 comprising first plurality of windings 132; second conductor line 134 comprising second plurality of windings 136; and third conductor line 138 comprising third plurality of windings 140. In this illustrative example, each winding of first plurality of windings 132, second plurality of windings 136, and third plurality of windings 140 has a number of turns selected based on the desired ratio of line voltage to phase voltage. Harmonic mitigation may increase as a number of windings included in each of first plurality of windings 132, second plurality of windings 136, and third plurality of windings 140 increases.

In one illustrative example, each winding in each of first plurality of windings 132, second plurality of windings 136, and third plurality of windings 140 has a phase that is substantially equivalent to one of plurality of delta phases 142 for transformer 100. As used herein, a first phase may be substantially equivalent to a second phase by being substantially equal to the second phase in magnitude or offset from the second phase by about 180 degrees, about 360 degrees, or some multiple thereof.

When source 108 takes the form of three-phase source 112 and plurality of input lines 114 includes three input lines, plurality of delta phases 142 includes three delta phases in this illustrative example. These three delta phases may be the phase differences between the three input connection points 131 formed by the three input lines. These three delta phases may be offset from each other by about 120 degrees.

Plurality of delta phases 142 correspond to delta line configuration 144. In other words, plurality of delta phases 142 may be the phases that plurality of conductor lines 120 would have if plurality of conductor lines 120 were connected in delta line configuration 144. With delta line configuration 144, each end of a conductor line would be connected to the end of another conductor line such that plurality of conductor lines 120 formed a substantially equilateral triangle.

In this manner, first plurality of windings 132, second plurality of windings 136, and third plurality of windings 140 may each include windings having phases that are consistent with delta line configuration 144. A phase may be consistent with delta line configuration 144 when the phase is substantially equivalent to one of plurality of delta phases 142.

In a first illustrative example, first plurality of windings 132, second plurality of windings 136, and third plurality of windings 140 each include five windings. Each of the five windings in each of plurality of conductor lines 120 may have a phase that is substantially equivalent to one of plurality of delta phases 142. In particular, the phases for the five windings in each of plurality of conductor lines 120 may include phases that are substantially equivalent to at least two different delta phases.

In a second illustrative example, first plurality of windings 132, second plurality of windings 136, and third plurality of windings 140 each include six windings that are consistent with delta line configuration 144. Each of the six windings in each of plurality of conductor lines 120 may have a phase that is substantially equivalent to one of plurality of delta phases 142. In particular, the phases for the five windings in each of plurality of conductor lines 120 may include phases that are substantially equivalent to at least two different delta phases.

In some illustrative examples, first plurality of windings 132, second plurality of windings 136, and third plurality of windings 140 may each include windings having phases that are consistent with wye line configuration 122. A phase may be consistent with wye line configuration 122 when the phase is substantially equivalent to one of plurality of wye phases 146.

For example, each winding in each of first plurality of windings 132, second plurality of windings 136, and third plurality of windings 140 may have a phase that is substantially equivalent to one of plurality of wye phases 146 for transformer 100. Plurality of wye phases 146 correspond to wye line configuration 122. In particular, each of plurality of wye phases 146 is the phase difference between a corresponding one of input connection points 131 and neutral point 115. In some cases, plurality of wye phases 146 may be referred to as a plurality of line phases that correspond to plurality of conductor lines 120. When source 108 takes the form of three-phase source 112 and plurality of input lines 114 includes three input lines, plurality of wye phases 146 includes three wye phases that are offset from each other by about 120 degrees.

In a first illustrative example, first plurality of windings 132, second plurality of windings 136, and third plurality of windings 140 each include four windings having phases that are consistent with wye line configuration 122. In other words, each of the four windings in each of plurality of conductor lines 120 may have a phase that is substantially equivalent to one of plurality of wye phases 146.

In a second illustrative example, first plurality of windings 132, second plurality of windings 136, and third plurality of windings 140 each include six windings having phases that are consistent with wye line configuration 122. In other words, each of the six windings in each of plurality of conductor lines 120 may have a phase that is substantially equivalent to one of plurality of wye phases 146.

Transformer 100 may have output connection points 148 to which a plurality of output lines may be connected. Output connection points 148 may be out of phase by about 120 degrees.

In one illustrative example, transformer 100 may be a three-phase autotransformer having wye line-delta phase configuration 151. With wye line-delta phase configuration 151, plurality of conductor lines 120 are wound around core 116 according to wye line configuration 122. Further, with wye line-delta phase configuration 151, each winding of each of plurality of conductor lines 120 may have a phase that is substantially equivalent to one of plurality of delta phases 142.

In particular, with wye line-delta phase configuration 151, each of plurality of conductor lines 120 may include at least two windings of at least two different phases between neutral point 115 and an output connection point corresponding to that conductor line. Each of the at least two different phases is substantially equivalent to one of plurality of delta phases 142. As one illustrative example, without limitation, first plurality of windings 132 may include at least two windings of at least two different phases between neutral point 115 and first output connection point 150 associated with first conductor line 130.

Similarly, second plurality of windings 136 may include at least two windings of at least two different phases between neutral point 115 and second output connection point 152 associated with second conductor line 134. The at least two different phases may be consistent with delta line configuration 144. Further, third plurality of windings 140 may include at least two windings of at least two different phases between neutral point 115 and third output connection point 154 associated with third conductor line 138. The at least two different phases may be consistent with delta line configuration 144.

In another illustrative example, transformer 100 may take the form of a three-phase autotransformer having wye line-wye phase configuration 155. With wye line-wye phase configuration 155, plurality of conductor lines 120 are wound around core 116 according to wye line configuration 122. Further, with wye line-wye phase configuration 155, each winding of each of plurality of conductor lines 120 may have a phase that is substantially equivalent to one of plurality of wye phases 146.

In particular, with wye line-wye phase configuration 155, each of plurality of conductor lines 120 may include at least three windings in which each winding has a phase substantially equivalent to one of plurality of wye phases 146. For example, without limitation, first plurality of windings 132, second plurality of windings 136, and third plurality of windings 140 may be wound around core 116 such that a phase of each winding of first conductor line 130, second conductor line 134, and third conductor line 138 is consistent with wye line configuration 122.

Both wye line-delta phase configuration 151 and wye line-wye phase configuration 155 for transformer 100 enable improved harmonic mitigation. In other words, undesired harmonic currents 128, and thereby, harmonic distortion, may be reduced to within selected tolerances. The improved harmonic mitigation achieved with these two configurations may reduce the need for using additional harmonic filters and noise filters. In this manner, the overall weight of transformer 100 or the system within which transformer 100 is implemented may be reduced.

Further, improved harmonic mitigation may allow improved performance of the electrical power system and power distribution system with which transformer 100 is associated. This electrical power system and power distribution system may be used to supply power to one or more systems in a platform such as, for example, without limitation, an aircraft, an unmanned aerial vehicle, a ship, a spacecraft, a ground vehicle, a piece of equipment, a landing system, or some other type of platform.

The illustration of transformer 100 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, although each of plurality of conductor lines 120 is described above as having three windings, four windings, five windings, or six windings, any number of windings greater than three may be used. Depending on the implementation, with either wye line-delta phase configuration 151 or wye line-wye phase configuration 155, each of plurality of conductor lines 120 may include eight, ten, fourteen, twenty, or some other number of windings.

Figure 2:
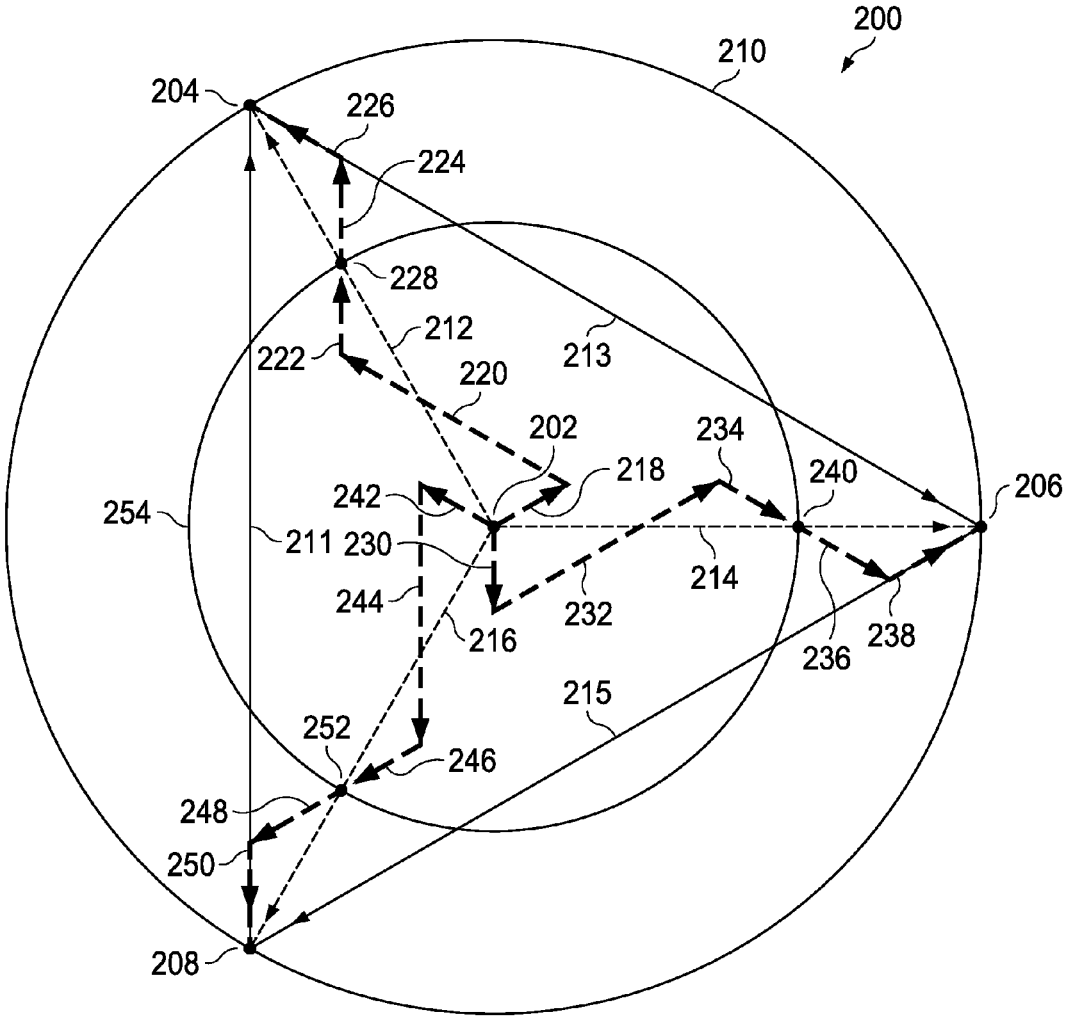
FIG. 2 is an illustration of a phasor diagram for a transformer having a wye line-delta phase configuration in accordance with an illustrative embodiment.

With reference now to FIG. 2, an illustration of a phasor diagram for a transformer having a wye line-delta phase configuration is depicted in accordance with an illustrative embodiment. In this illustrative example, phasor diagram 200 represents a transformer having a wye line-delta phase configuration, such as transformer 100 having wye line-delta phase configuration 151 in FIG. 1.

As depicted, phasor diagram 200 identifies neutral point 202, first input connection point 204, second input connection point 206, and third input connection point 208. Neutral point 202 represents a neutral point for a transformer, such as neutral point 115 in FIG. 1. First input connection point 204, second input connection point 206, and third input connection point 208 represent input connection points for a transformer, such as input connection points 131 in FIG. 1.

In this illustrative example, first input connection point 204, second input connection point 206, and third input connection point 208 lie along outer circle 210, which represents the voltage level corresponding to these input connection points. As depicted, these three input connection points are substantially equidistant from each other along outer circle 210, which indicates that the alternating currents corresponding to these input connections points are out of phase by about 120 degrees.

Delta phase 211 is shown in the direction from third input connection point 208 to first input connection point 204. Delta phase 213 is shown in the direction from first input connection point 204 to second input connection point 206. Further, delta phase 215 is shown in the direction from second input connection point 206 to third input connection point 208. Delta phase 211, delta phase 213, and delta phase 215 are an example of plurality of delta phases 142 in FIG. 1. In this illustrative example, delta phase 211, delta phase 213, and delta phase 215 are offset by about 120 degrees.

Wye phase 212, wye phase 214, and wye phase 216 are the phase differences between neutral point 202 and first input connection point 204, between neutral point 202 and second input connection point 206, and between neutral point 202 and third input connection point 208, respectively. Wye phase 212, wye phase 214, and wye phase 216 may correspond to a first conductor line, a second conductor line, and a third conductor line, respectively.

With the wye line-delta phase configuration, these three conductor lines may be connected together at the neutral point, which is represented by neutral point 202 in phasor diagram 200, to form a wye line configuration. Further, each of these three conductor lines may have at least three windings having the same or different numbers of turns.

In this illustrative example, the first conductor line corresponding to wye phase 212, the second conductor line corresponding to wye phase 214, and the third conductor line corresponding to wye phase 216 each has five windings, each of which has a selected number of turns that may determine the voltage levels of the phase voltages at the output connection points. The five windings for the first conductor line are represented by winding phase 218, winding phase 220, winding phase 222, winding phase 224, and winding phase 226.

As a group, winding phase 218, winding phase 220, winding phase 222, winding phase 224, and winding phase 226 include three different phases consistent with a delta line configuration. A winding phase for a particular winding is the phase of the particular winding.

As depicted, winding phase 218 is substantially equivalent to delta phase 215. Winding phase 220 and winding phase 226 are substantially equivalent to delta phase 213. Winding phase 222 and winding phase 224 are substantially equivalent to delta phase 211. First output connection point 228 represents the output connection point corresponding to the first conductor line.

In a similar manner, the five windings for the second conductor line corresponding to wye phase 214 are represented by winding phase 230, winding phase 232, winding phase 234, winding phase 236, and winding phase 238. As a group, winding phase 230, winding phase 232, winding phase 234, winding phase 236, and winding phase 238 include three different phases consistent with the delta line configuration.

As depicted, winding phase 230 is substantially equivalent to delta phase 211. Winding phase 232 and winding phase 238 are substantially equivalent to delta phase 215. Winding phase 234 and winding phase 236 are substantially equivalent to delta phase 213. Second output connection point 240 represents the output connection point corresponding to the second conductor line.

Further, the five windings for the third conductor line corresponding to wye phase 216 are represented by winding phase 242, winding phase 244, winding phase 246, winding phase 248, and winding phase 250. As a group, winding phase 242, winding phase 244, winding phase 246, winding phase 248, and winding phase 250 include three different phases consistent with the delta line configuration.

As depicted, winding phase 242 is substantially equivalent to delta phase 213. Winding phase 244 and winding phase 250 are substantially equivalent to delta phase 211. Winding phase 246 and winding phase 248 are substantially equivalent to delta phase 215. Third output connection point 252 represents the output connection point corresponding to the third conductor line.

As depicted, first output connection point 228, second output connection point 240, and third output connection point 252 lie along inner circle 254. Inner circle 254 represents the reduced voltage level produced by the transformer represented by phasor diagram 200. With the wye line-delta phase configuration illustrated in FIG. 2, the voltage level of the phase voltages at these output connection points may be a selected percentage of the line voltages for the corresponding conductor lines. In this illustrative example, the selected percentage is greater than about 65 percent.

The number of windings included in each conductor line and the number of turns selected for each of the number of windings may determine the percentage change in voltage level achieved by the transformer. Although the transformer represented by phasor diagram 200 is described as having conductor lines that each include five windings, other numbers of windings may be used in other illustrative examples.

Figure 3:
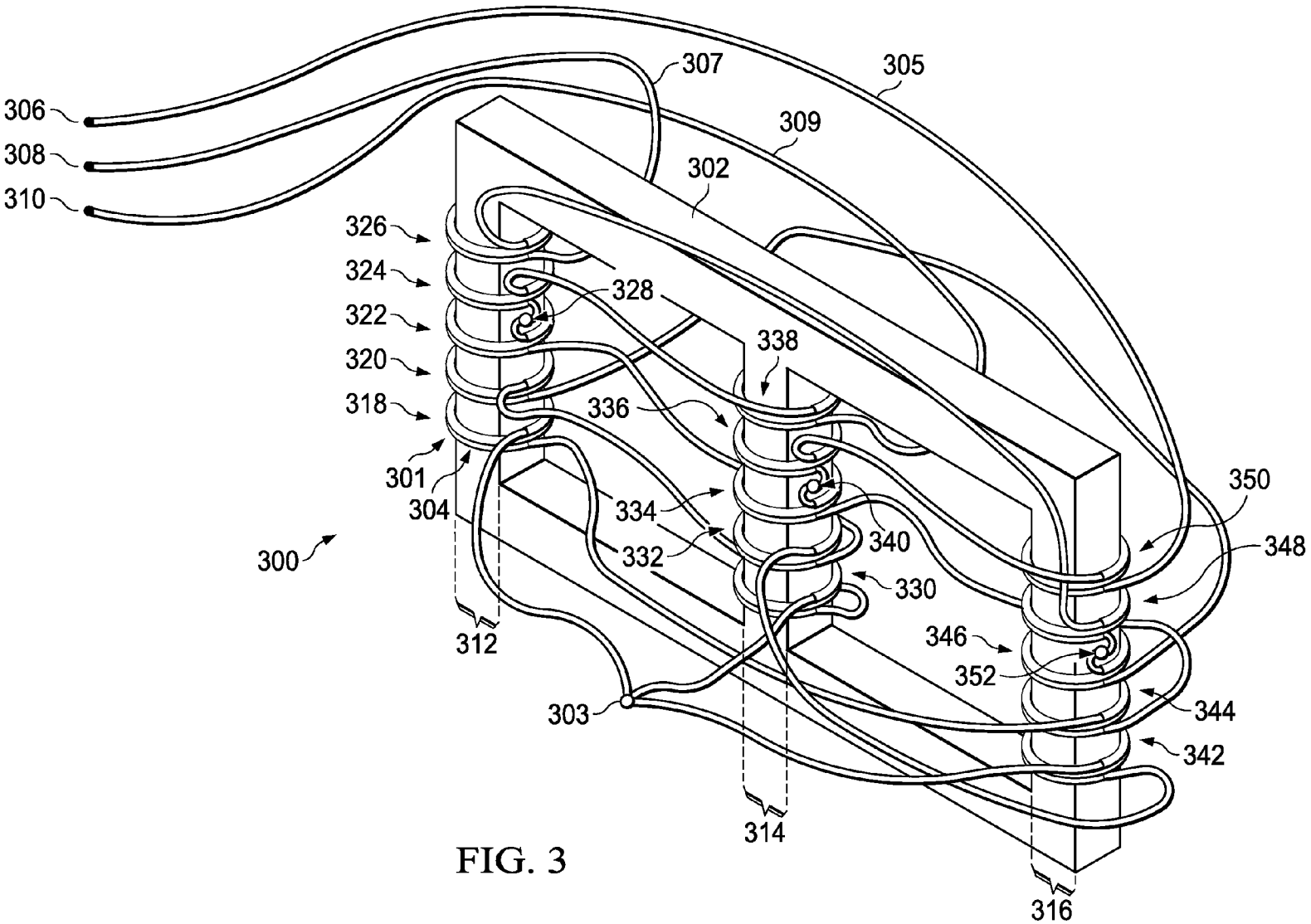
FIG. 3 is an illustration of a transformer having a wye line-delta phase configuration in accordance with an illustrative embodiment.

With reference now to FIG. 3, an illustration of a transformer having a wye line-delta phase configuration is depicted in accordance with an illustrative embodiment. In this illustrative example, transformer 300 is an example of one implementation for transformer 100 in FIG. 1. In particular, transformer 300 may have wye line-delta phase configuration 301, which may be an example of one implementation for wye line-delta phase configuration 151 in FIG. 1.

Transformer 300 may be the transformer represented by phasor diagram 200 in FIG. 2. As depicted, transformer 300 includes core 302 and plurality of conductor lines 304. Core 302 and plurality of conductor lines 304 are examples of implementations for core 116 and plurality of conductor lines 120, respectively, in FIG. 1.

Plurality of conductor lines 304 may be connected together at neutral point 303 according to a wye line configuration. Plurality of conductor lines 304 includes first conductor line 305, second conductor line 307, and third conductor line 309. First conductor line 305, second conductor line 307, and third conductor line 309 connect to and receive alternating current from a three-phase source (not shown) at first input connection point 306, second input connection point 308, and third input connection point 310, respectively.

First input connection point 306, second input connection point 308, and third input connection point 310 may be an example of one implementation for input connection points 131 in FIG. 1. Further, first input connection point 306, second input connection point 308, and third input connection point 310 may be represented by first input connection point 204, second input connection point 206, and third input connection point 208, respectively, in phasor diagram 200 in FIG. 2.

Each of first conductor line 305, second conductor line 307, and third conductor line 309 includes five windings that are wound around the limbs of core 302. Each of the five windings has a selected number of turns. The five windings for each conductor line have three different phases. As depicted, core 302 includes limb 312, limb 314, and limb 316. Limb 312, limb 314, and limb 316 are an example of one implementation for plurality of limbs 118 of core 116 in FIG. 1.

As depicted, windings 318, 320, 322, 324, and 326 are wound around limb 312. Windings 330, 332, 334, 336, and 338 are wound around limb 314. Windings 342, 344, 346, 348, and 350 are wound around limb 316.

Windings 318, 334, 336, 344, and 350 belong to first conductor line 305. Windings 330, 320, 346, 348, and 326 belong to second conductor line 307. Windings 342, 332, 322, 324, and 338 belong to third conductor line 309. Each of the windings of each of plurality of conductor lines 304 may be substantially equivalent to one of delta phase 211, delta phase 213, and delta phase 215 in FIG. 2. Further, each of the windings may have a selected number of turns that determines the voltage levels at output connection points 340, 352 and 328.

In particular, windings 318, 334, 336, 344, and 350 may have winding phases 218, 220, 222, 224, and 226, respectively, shown in FIG. 2. Windings 330, 320, 346, 348, and 326 may have winding phases 230, 232, 234, 236, and 238, respectively, shown in FIG. 2. Further, windings 342, 332, 322, 324, and 338 may have winding phases 242, 244, 246, 248, and 250, respectively, shown in FIG. 2.

In this illustrative example, first output connection point 340, second output connection point 352, and third output connection point 328 are associated with first conductor line 305, second conductor line 307, and third conductor line 309, respectively. First output connection point 340, second output connection point 352, and third output connection point 328 are represented in phasor diagram 200 in FIG. 2 by first output connection point 228, second output connection point 240, and third output connection point 252, respectively, in FIG. 2. The voltage levels at first output connection point 340, second output connection point 352, and third output connection point 328 may be reduced to a selected percentage of the voltage levels at first input connection point 306, second input connection point 308, and third input connection point 310, respectively.

Wye line-delta phase configuration 301 for transformer 300 may help reduce harmonic currents and thereby, harmonic distortion, in the electrical power system to which transformer 300 belongs or is electrically connected. This improved harmonic mitigation may improve the overall performance of the electrical power system and reduce the need for additional filters, thereby reducing the overall weight of the electrical power system.

Figure 4:
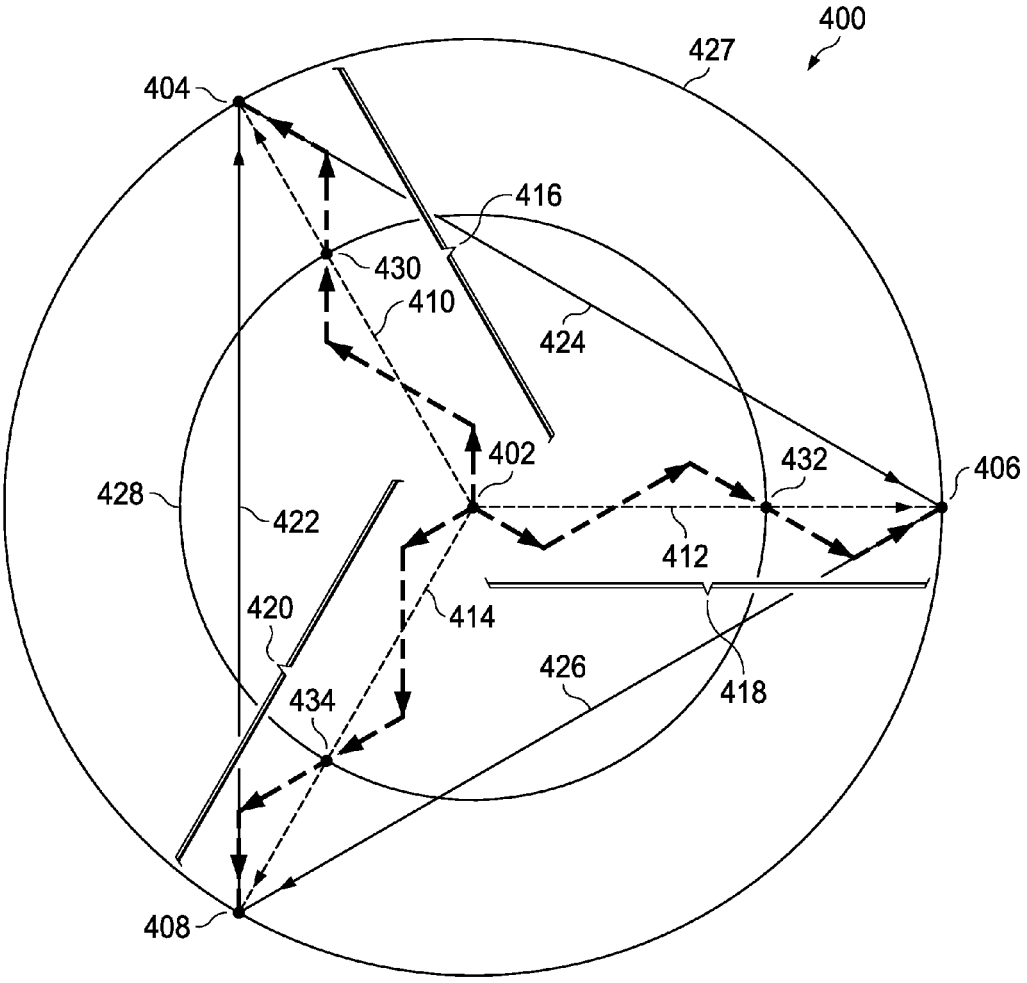
FIG. 4 is an illustration of a phasor diagram for a transformer having a wye line-delta phase configuration in accordance with an illustrative embodiment.

With reference now to FIG. 4, an illustration of a phasor diagram for a transformer having a wye line-delta phase configuration is depicted in accordance with an illustrative embodiment. In this illustrative example, phasor diagram 400 represents a transformer having a different wye line-delta phase configuration than the transformer represented by phasor diagram 200 in FIG. 2. In this illustrative example, each of the conductor lines of the transformer may have five windings.

As depicted, phasor diagram 400 identifies neutral point 402, first input connection point 404, second input connection point 406, and third input connection point 408. Wye phase 410, wye phase 412, and wye phase 414 are the phase differences between neutral point 402 and first input connection point 404, between neutral point 402 and second input connection point 406, and between neutral point 402 and third input connection point 408, respectively.

Wye phase 410, wye phase 412, and wye phase 412 correspond to a first conductor line, a second conductor line, and a third conductor line, respectively. With the wye line-delta phase configuration, these three conductor lines are connected together at the neutral point, which is represented by neutral point 402 in phasor diagram 400, to form the wye line configuration. In this illustrative example, each of these three conductor lines has windings with phases that are consistent with a delta line configuration.

In particular, the first conductor line corresponding to wye phase 410, the second conductor line corresponding to wye phase 412, and the third conductor line corresponding to wye phase 414 each has five windings. The five windings for the first conductor line are represented by first plurality of winding phases 416. Similarly, the five windings for the second conductor line are represented by second plurality of winding phases 418. The five windings for the third connector line are represented by third plurality of winding phases 420.

Each winding phase of first plurality of winding phases 416, each winding phase of second plurality of winding phases 418, and each winding phase of third plurality of winding phases 420 is substantially equivalent to one of delta phase 422, delta phase 424, and delta phase 426. Delta phase 422, delta phase 424, and delta phase 426 are offset from each other by about 120 degrees.

As depicted, first input connection point 404, second input connection point 406, and third input connection point 408 lie along outer circle 427 in phasor diagram 400. Outer circle 427 represents the voltage level for the line voltages corresponding to the first conductor line, second conductor line, and third conductor line. Inner circle 428 in phasor diagram 400 represents the voltage level of the phase voltage that may be achieved by the transformer represented by phasor diagram 400.

In this illustrative example, first output connection point 430, second output connection point 432, and third output connection point 434 represent the output connection points corresponding to the first conductor line, the second conductor line, and the third conductor line, respectively. These output connection points lie along inner circle 428. In this illustrative example, the voltage level of the phase voltage at each of these output connection points may be about 65 percent of the voltage level of the line voltages.

Figure 5:
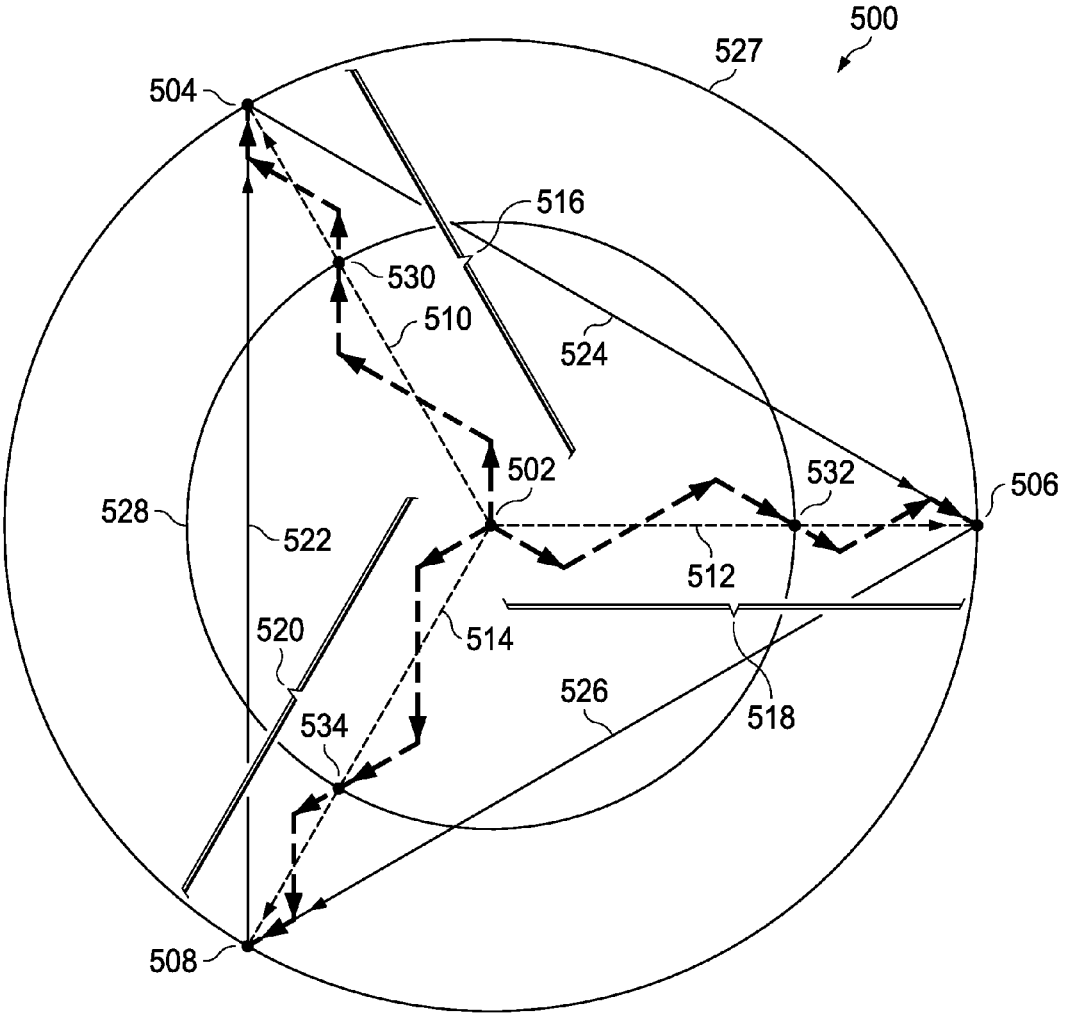
FIG. 5 is an illustration of a phasor diagram for a transformer having a wye line-delta phase configuration in accordance with an illustrative embodiment.

With reference now to FIG. 5, an illustration of a phasor diagram for a transformer having a wye line-delta phase configuration is depicted in accordance with an illustrative embodiment. In this illustrative example, phasor diagram 500 represents a transformer having yet another wye line-delta phase configuration that is different from the transformer represented by phasor diagram 400 in FIG. 4 and phasor diagram 200 in FIG. 2. In this illustrative example, each of the conductor lines of the transformer may have six windings.

As depicted, phasor diagram 500 identifies neutral point 502, first input connection point 504, second input connection point 506, and third input connection point 508. Wye phase 510, wye phase 512, and wye phase 514 are the phase differences between neutral point 502 and first input connection point 504, between neutral point 502 and second input connection point 506, and between neutral point 502 and third input connection point 508, respectively.

Wye phase 510, wye phase 512, and wye phase 512 correspond to a first conductor line, a second conductor line, and a third conductor line, respectively. These three conductor lines are connected together at neutral point 502 to form a wye line configuration. In this illustrative example, each of these three conductor lines has six windings with phases that are consistent with a delta line configuration.

The six windings for the first conductor line are represented by first plurality of winding phases 516. Similarly, the six windings for the second conductor line are represented by second plurality of winding phases 518. The six windings for the third connector line are represented by third plurality of winding phases 520.

Each winding phase of first plurality of winding phases 516, each winding phase of second plurality of winding phases 518, and each winding phase of third plurality of winding phases 520 is substantially equivalent to one of delta phase 522, delta phase 524, and delta phase 526. Delta phase 522, delta phase 524, and delta phase 526 are offset from each other by about 120 degrees.

As depicted, first input connection point 504, second input connection point 506, and third input connection point 508 lie along outer circle 527 in phasor diagram 500. Outer circle 527 represents the voltage level for the line voltages corresponding to the first conductor line, second conductor line, and third conductor line. Inner circle 528 in phasor diagram 500 represents the voltage level of the phase voltage that may be achieved by the transformer represented by phasor diagram 500.

In this illustrative example, first output connection point 530, second output connection point 532, and third output connection point 534 represent the output connection points corresponding to the first conductor line, the second conductor line, and the third conductor line, respectively. These output connection points lie along inner circle 528. In this illustrative example, the voltage level of the phase voltage at each of these output connection points may be about 65 percent of the voltage level of the line voltages.

Figure 6:
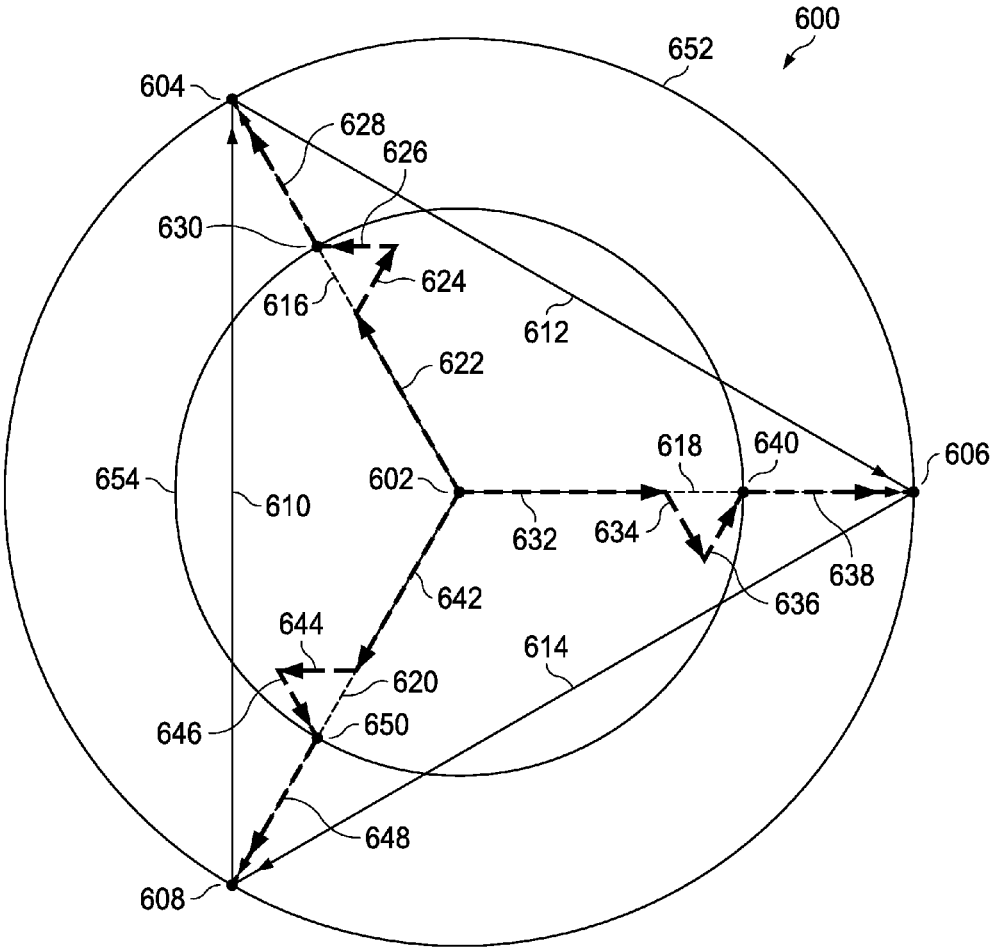
FIG. 6 is an illustration of a phasor diagram for a transformer having a wye line-wye phase configuration in accordance with an illustrative embodiment.

With reference now to FIG. 6, an illustration of a phasor diagram for a transformer having a wye line-wye phase configuration is depicted in accordance with an illustrative embodiment. In this illustrative example, phasor diagram 600 represents a transformer having a wye line-wye phase configuration, such as transformer 100 having wye line-wye phase configuration 155 in FIG. 1.

As depicted, phasor diagram 600 identifies neutral point 602, first input connection point 604, second input connection point 606, and third input connection point 608. Neutral point 602 represents a neutral point for a transformer, such as neutral point 115 in FIG. 1. First input connection point 604, second input connection point 606, and third input connection point 608 represent input connection points for a transformer, such as input connection points 131 in FIG. 1.

Delta phase 610 is shown in the direction from third input connection point 608 to first input connection point 604. Delta phase 612 is shown in the direction from first input connection point 604 to second input connection point 606. Further, delta phase 614 is shown in the direction from second input connection point 606 to third input connection point 608.

Wye phase 616, wye phase 618, and wye phase 620 are the phase differences between neutral point 602 and first input connection point 604, between neutral point 602 and second input connection point 606, and between neutral point 602 and third input connection point 608, respectively. Wye phase 616, wye phase 618, and wye phase 620 may correspond to a first conductor line, a second conductor line, and a third conductor line, respectively. These three conductor lines may be connected together at a neutral point, which is represented by neutral point 602, in phasor diagram 600, to form a wye line configuration.

In this manner, wye phase 616, wye phase 618, and wye phase 620 may also be referred to as line phases. These wye phases are an example of plurality of wye phases 146 in FIG. 1.

In this illustrative example, each of the first conductor line corresponding to wye phase 616, the second conductor line corresponding to wye phase 618, and the third conductor line corresponding to wye phase 618 has four windings. Each of these windings has a phase consistent with a wye line configuration. In other words, each of these windings has a phase that is substantially equivalent to one of wye phase 616, wye phase 618, and wye phase 620.

The four windings for the first conductor line corresponding to wye phase 616 are represented by winding phase 622, winding phase 624, winding phase 626, and winding phase 628. As a group, winding phase 622, winding phase 624, winding phase 626, and winding phase 628 include three different phases consistent with the wye line configuration.

As depicted, winding phase 622 and winding phase 628 are substantially equivalent to wye phase 616. Winding phase 624 is substantially equivalent to wye phase 620. Winding phase 626 is substantially equivalent to wye phase 618. First output connection point 630 represents the output connection point corresponding to the first conductor line.

In a similar manner, the four windings for the second conductor line corresponding to wye phase 614 are represented by winding phase 632, winding phase 634, winding phase 636, and winding phase 638. As a group, winding phase 632, winding phase 634, winding phase 636, and winding phase 638 include three different phases consistent with the wye line configuration.

As depicted, winding phase 632 and winding phase 638 are substantially equivalent to wye phase 618. Winding phase 634 is substantially equivalent to wye phase 616. Winding phase 636 is substantially equivalent to wye phase 620. Second output connection point 640 represents the output connection point corresponding to the second conductor line.

Further, the four windings for the third conductor line corresponding to wye phase 616 are represented by winding phase 642, winding phase 644, winding phase 646, and winding phase 648. As a group, winding phase 642, winding phase 644, winding phase 646, and winding phase 648 include three different phases consistent with the wye line configuration.

As depicted, winding phase 642 and winding phase 648 are substantially equivalent to wye phase 620. Winding phase 644 is substantially equivalent to wye phase 618. Winding phase 646 is substantially equivalent to wye phase 616. Third output connection point 650 represents the output connection point corresponding to the third conductor line.

In this illustrative example, first input connection point 604, second input connection point 606, and third input connection point 608 lie along outer circle 652, which represents the voltage level corresponding to these input connection points. First output connection point 630, second output connection point 640, and third output connection point 650 lie along inner circle 654. Inner circle 654 represents the reduced voltage level produced by the transformer represented by phasor diagram 600.

With the wye line-wye phase configuration illustrated in FIG. 6, the voltage level of the phase voltages at these output connection points may be a selected percentage of the line voltages for the corresponding conductor lines. In this illustrative example, the selected percentage is greater than about 65 percent.

Figure 7:
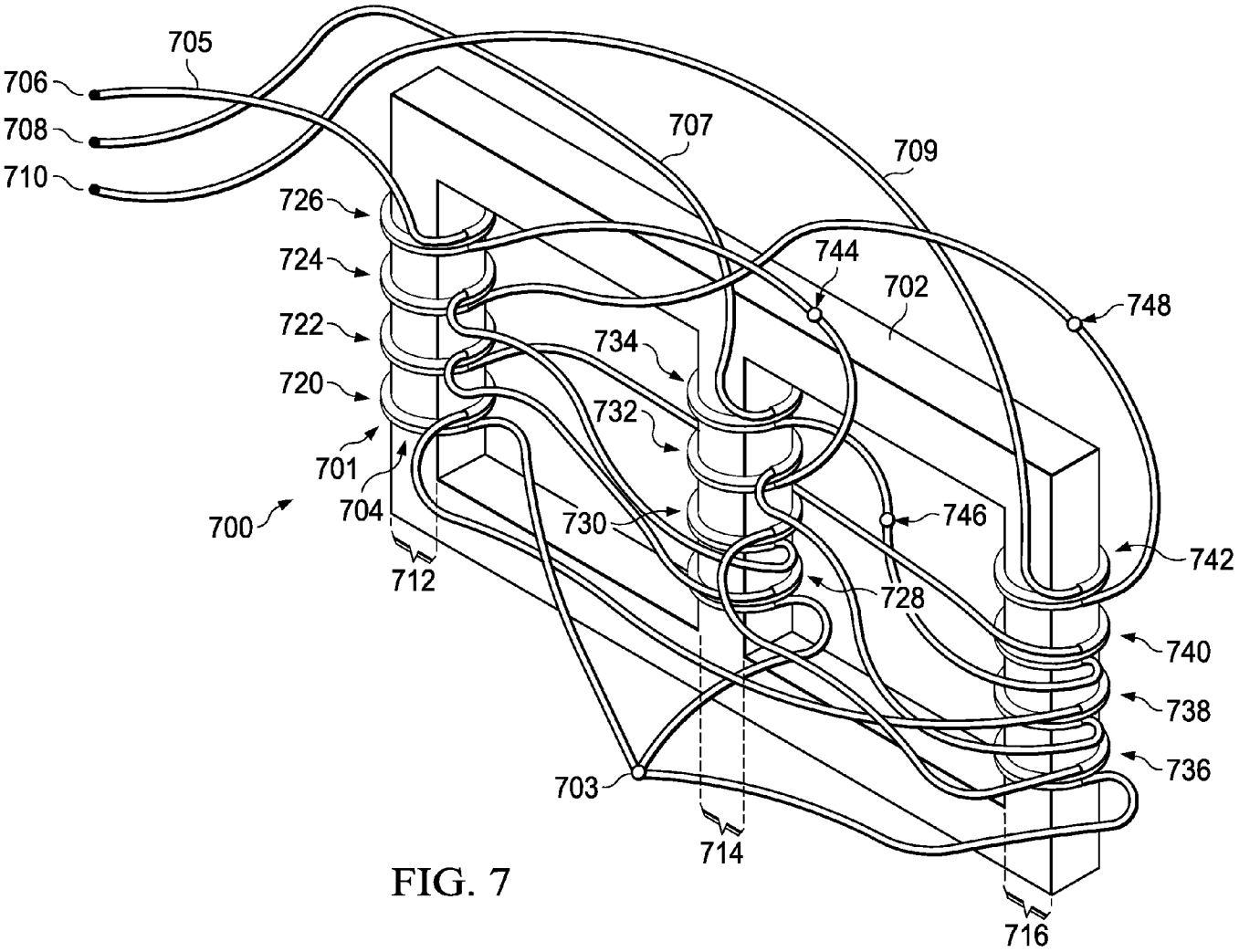
FIG. 7 is an illustration of a transformer having a wye line-wye phase configuration in accordance with an illustrative embodiment.

With reference now to FIG. 7, an illustration of a transformer having a wye line-wye phase configuration is depicted in accordance with an illustrative embodiment. In this illustrative example, transformer 700 is an example of one implementation for transformer 100 in FIG. 1. In particular, transformer 700 may have wye line-wye phase configuration 701, which may be an example of one implementation for wye line-wye phase configuration 155 in FIG. 1.

Transformer 700 may be the transformer represented by phasor diagram 600 in FIG. 6. As depicted, transformer 700 includes core 702 and plurality of conductor lines 704. Core 702 and plurality of conductor lines 704 are examples of implementations for core 116 and plurality of conductor lines 120, respectively, in FIG. 1.

Plurality of conductor lines 704 may be connected together at neutral point 703 according to a wye line configuration. Plurality of conductor lines 704 includes first conductor line 705, second conductor line 707, and third conductor line 709. First conductor line 705, second conductor line 707, and third conductor line 709 connect to and receive alternating current from a three-phase source (not shown) at first input connection point 706, second input connection point 708, and third input connection point 710, respectively.

First input connection point 706, second input connection point 708, and third input connection point 710 may be an example of one implementation for input connection points 131 in FIG. 1. Further, first input connection point 706, second input connection point 708, and third input connection point 710 may be represented by first input connection point 604, second input connection point 606, and third input connection point 608, respectively, in phasor diagram 600 in FIG. 6.

Each of first conductor line 705, second conductor line 707, and third conductor line 709 includes four windings that are wound around the limbs of core 702. Each of the windings may have a selected number of turns that determines the voltage levels at output connection points 744, 746 and 748. The four windings for each conductor line have at least three different phases. As depicted, core 702 includes limb 712, limb 714, and limb 716. Limb 712, limb 714, and limb 716 are an example of one implementation for plurality of limbs 118 of core 116 in FIG. 1.

As depicted, windings 720, 722, 724, and 726 are wound around limb 712. Windings 728, 730, 732, and 734 are wound around limb 714. Windings 736, 738, 740, and 742 are wound around limb 716.

Windings 720, 738, 732, and 726 belong to first conductor line 705. Windings 728, 722, 740, and 734 belong to second conductor line 707. Windings 736, 730, 724, and 742 belong to third conductor line 709. Each of the windings of each of plurality of conductor lines 704 may be substantially equivalent to one of wye phase 616, wye phase 618, and wye phase 620 in FIG. 6.

In particular, windings 720, 738, 732, and 726 may have winding phases 622, 624, 626, and 628, respectively, shown in FIG. 6. Windings 728, 722, 740, and 734 may have winding phases 632, 634, 636, and 638, respectively, shown in FIG. 6. Further, windings 736, 730, 724, and 742 may have winding phases 642, 644, 646, and 648, respectively, shown in FIG. 6.

In this illustrative example, first output connection point 744, second output connection point 746, and third output connection point 748 are associated with first conductor line 705, second conductor line 707, and third conductor line 709, respectively. First output connection point 744, second output connection point 746, and third output connection point 748 are represented in phasor diagram 600 in FIG. 6 by first output connection point 630, second output connection point 640, and third output connection point 650, respectively, in FIG. 6. The voltage levels at first output connection point 744, second output connection point 746, and third output connection point 748 may be reduced to a selected percentage of the voltage levels at first input connection point 706, second input connection point 708, and third input connection point 710, respectively.

Wye line-wye phase configuration 701 for transformer 700 may help reduce harmonic currents and thereby, harmonic distortion, in the electrical power system to which transformer 700 belongs or is electrically connected. This improved harmonic mitigation may improve the overall performance of the electrical power system and reduce the need for additional filters, thereby reducing the overall weight of the electrical power system.

Figure 8:
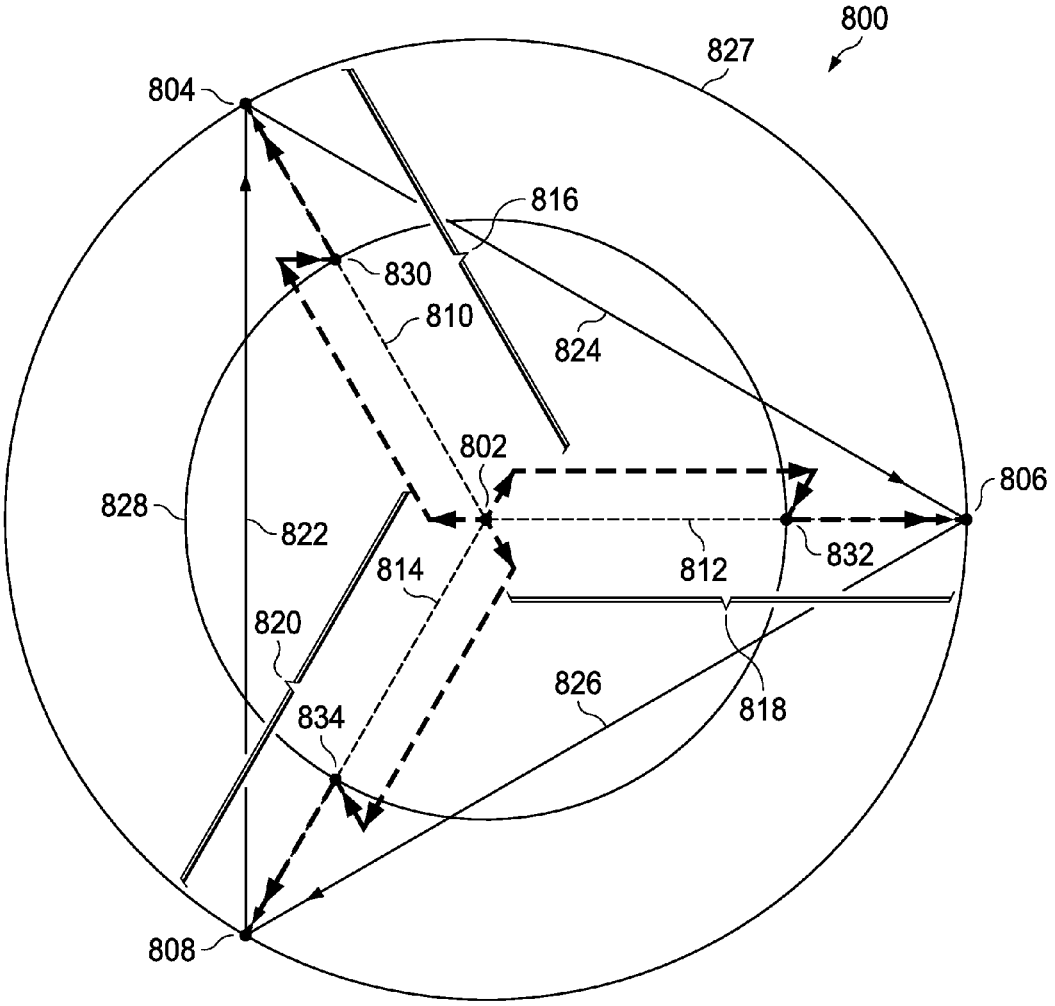
FIG. 8 is an illustration of a phasor diagram for a transformer having a wye line-wye phase configuration in accordance with an illustrative embodiment.

With reference now to FIG. 8, an illustration of a phasor diagram for a transformer having a wye line-wye phase configuration is depicted in accordance with an illustrative embodiment. In this illustrative example, phasor diagram 800 represents a transformer having a different wye line-wye phase configuration than the transformer represented by phasor diagram 600 in FIG. 6.

As depicted, phasor diagram 800 identifies neutral point 802, first input connection point 804, second input connection point 806, and third input connection point 808. Wye phase 810, wye phase 812, and wye phase 814 correspond to a first conductor line, a second conductor line, and a third conductor line, respectively.

These three conductor lines are connected together at a neutral point, which is represented by neutral point 802 in phasor diagram 800, to form a wye line configuration. Wye phase 810, wye phase 812, and wye phase 814 are the phase differences between neutral point 802 and first input connection point 804, between neutral point 802 and second input connection point 806, and between neutral point 802 and third input connection point 808, respectively.

In particular, each of the first conductor line corresponding to wye phase 810, the second conductor line corresponding to wye phase 812, and the third conductor line corresponding to wye phase 814 has four windings with phases that are consistent with the wye line configuration. The four windings for the first conductor line are represented by first plurality of winding phases 816. Similarly, the four windings for the second conductor line are represented by second plurality of winding phases 818. The four windings for the third connector line are represented by third plurality of winding phases 820.

Each winding phase of first plurality of winding phases 816, each winding phase of second plurality of winding phases 818, and each winding phase of third plurality of winding phases 820 is substantially equivalent to one of wye phase 810, wye phase 812, and wye phase 814, respectively.

Delta phase 822, delta phase 824, and delta phase 826 are also depicted in this illustrative example. These delta phases correspond to a delta line configuration. However, in this illustrative example, the transformer has a wye line-wye phase configuration such that none of the windings that make up the transformer has a phase that is substantially equivalent to one of delta phase 822, delta phase 824, and delta phase 826.

As depicted, first input connection point 804, second input connection point 806, and third input connection point 808 lie along outer circle 827 in phasor diagram 800. Outer circle 827 represents the voltage level for the line voltages corresponding to the first conductor line, the second conductor line, and the third conductor line. Inner circle 828 in phasor diagram 800 represents the voltage level of the phase voltage that may be achieved by the transformer represented by phasor diagram 800.

In this illustrative example, first output connection point 830, second output connection point 832, and third output connection point 834 represent the output connection points corresponding to the first conductor line, the second conductor line, and the third conductor line, respectively. These output connection points lie along inner circle 828.

Figure 9:
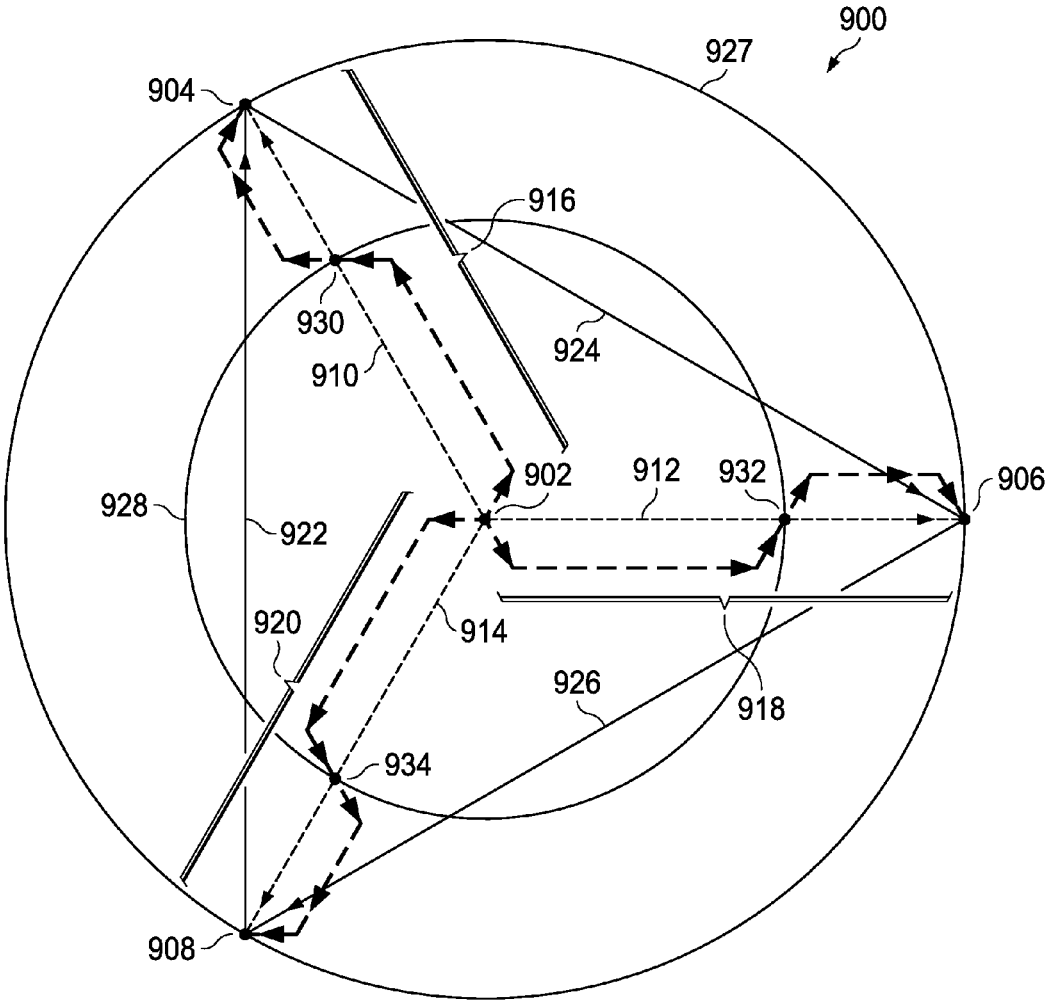
FIG. 9 is an illustration of a phasor diagram for a transformer having a wye line-wye phase configuration in accordance with an illustrative embodiment.

With reference now to FIG. 9, an illustration of a phasor diagram for a transformer having a wye line-wye phase configuration is depicted in accordance with an illustrative embodiment. In this illustrative example, phasor diagram 900 represents a transformer having yet another wye line-wye phase configuration different from the transformers represented by phasor diagram 600 in FIG. 6 and phasor diagram 800 in FIG. 8. In this illustrative example, each of the conductor lines of the transformer may have six windings.

As depicted, phasor diagram 900 identifies neutral point 902, first input connection point 904, second input connection point 906, and third input connection point 908. Wye phase 910, wye phase 912, and wye phase 912 correspond to a first conductor line, a second conductor line, and a third conductor line, respectively. In this illustrative example, each of these three conductor lines has six windings having phases that are consistent with a wye line configuration.

The six windings for the first conductor line are represented by first plurality of winding phases 916. Similarly, the six windings for the second conductor line are represented by second plurality of winding phases 918. The six windings for the third connector line are represented by third plurality of winding phases 920.

Each winding phase of first plurality of winding phases 916, each winding phase of second plurality of winding phases 918, and each winding phase of third plurality of winding phases 920 is substantially equivalent to one of wye phase 910, wye phase 912, and wye phase 914.

Delta phase 922, delta phase 924, and delta phase 926 are also depicted in this illustrative example. These delta phases correspond to a delta line configuration. However, in this illustrative example, the transformer has a wye line-wye phase configuration such that none of the windings that make up the transformer has a phase that is substantially equivalent to one of delta phase 922, delta phase 924, and delta phase 926.

As depicted, first input connection point 904, second input connection point 906, and third input connection point 908 lie along outer circle 927 in phasor diagram 900. In this illustrative example, first output connection point 930, second output connection point 932, and third output connection point 934 represent the output connection points corresponding to the first conductor line, the second conductor line, and the third conductor line, respectively. These output connection points lie along inner circle 928.

The illustrations in FIGS. 2-9 are not meant to imply physical or architectural limitations to the manner in which an illustrative embodiment may be implemented. Other components in addition to or in place of the ones illustrated may be used. Some components may be optional.

The different components shown in FIGS. 2-9 may be illustrative examples of how components shown in block form in FIG. 1 can be implemented as physical structures. Additionally, some of the components in FIGS. 2-9 may be combined with components in FIG. 1, used with components in FIG. 1, or a combination of the two.

As depicted in the illustrations of FIGS. 2-9, the wye line-delta phase configuration and wye line-wye phase configuration as described above for a transformer may be implemented in any number of ways. With the wye line-delta phase configuration, the transformer may have, for example, three conductor lines. Each of the three conductor lines may be implemented in a same manner.

Each conductor line may have at least three windings. In particular, each conductor line may have at least two windings with at least two different phases consistent with a delta line configuration between a neutral point for the transformer and an output connection point corresponding to the conductor line. The windings that make up a particular conductor line may be selected such that the length of each winding and placement of each winding along the particular conductor line determines the percentage change in voltage level produced by the transformer. The length of a winding may be defined as the number of turns of the winding in some illustrative examples.

With the wye line-wye phase configuration, the transformer may have, for example, three conductor lines. Each of the three conductor lines may be implemented in a same manner. Each conductor line may have at least three windings. In particular, the windings of each conductor line may have at least two different phases consistent with a wye line configuration. The windings that make up a particular conductor line may be selected such that the length of each winding and placement of each winding along the particular conductor line determines the percentage change in voltage level produced by the transformer.

Figure 10:
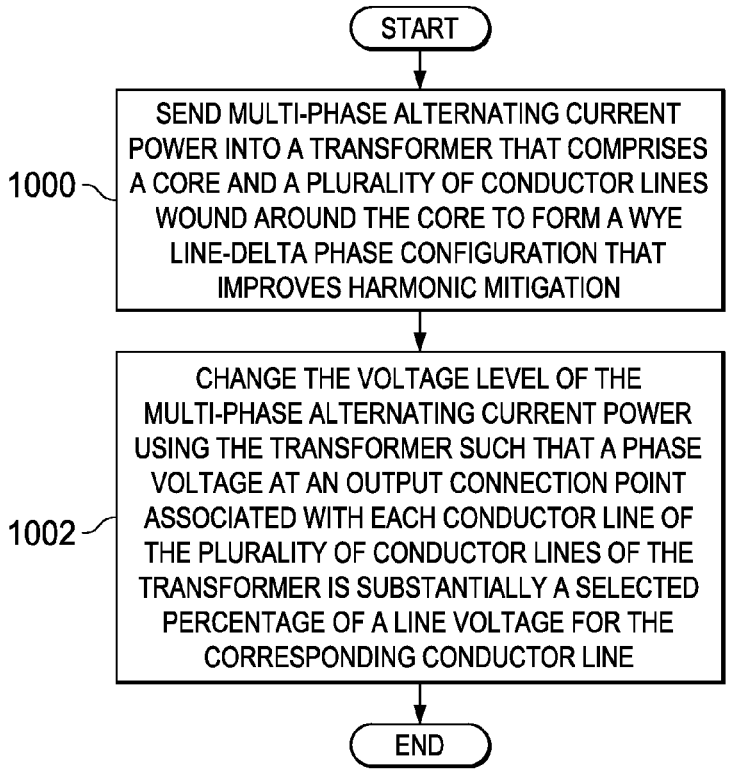
FIG. 10 is an illustration of a process for changing a voltage level of multi-phase alternating current power in the form of a flowchart in accordance with an illustrative embodiment.

With reference now to FIG. 10, an illustration of a process for changing a voltage level of multi-phase alternating current power is depicted in the form of a flowchart in accordance with an illustrative embodiment. The process illustrated in FIG. 10 may be implemented using transformer 100 in FIG. 1.

The process begins by sending multi-phase alternating current power into a transformer that comprises a core and a plurality of conductor lines wound around the core to form a wye line-delta phase configuration that improves harmonic mitigation (operation 1000). Next, the voltage level of the multi-phase alternating current power is changed using the transformer such that a phase voltage at an output connection point associated with each conductor line of the plurality of conductor lines of the transformer is substantially a selected percentage of a line voltage for the corresponding conductor line (operation 1002), with the process terminating thereafter.

Figure 11:
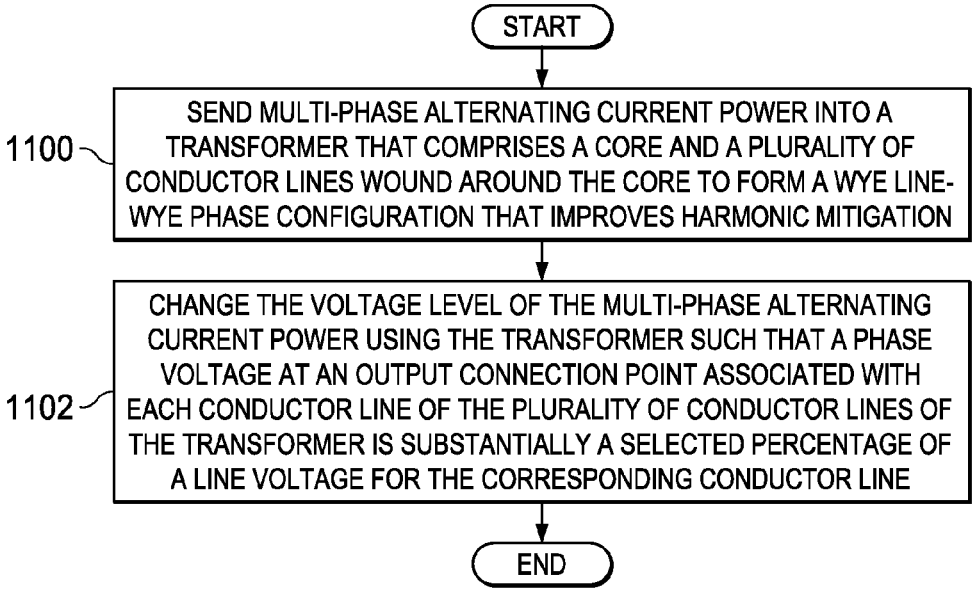
FIG. 11 is an illustration of a process for changing a voltage level of multi-phase alternating current power in the form of a flowchart in accordance with an illustrative embodiment.

With reference now to FIG. 11, an illustration of a process for changing a voltage level of multi-phase alternating current power is depicted in the form of a flowchart in accordance with an illustrative embodiment. The process illustrated in FIG. 11 may be implemented using transformer 100 in FIG. 1.

The process begins by sending multi-phase alternating current power into a transformer that comprises a core and a plurality of conductor lines wound around the core to form a wye line-wye phase configuration that improves harmonic mitigation (operation 1100). Next, the voltage level of the multi-phase alternating current power is changed using the transformer such that a phase voltage at an output connection point associated with each conductor line of the plurality of conductor lines of the transformer is substantially a selected percentage of a line voltage for the corresponding conductor line (operation 1102), with the process terminating thereafter.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, and/or a portion of an operation or step.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. A transformer comprising:

a core that includes a first leg, a second leg, and a third leg; and a plurality of conductor lines in which each conductor line in the plurality of conductor lines comprises at least three windings wound around the core such that a phase voltage at an output connection point associated with a corresponding conductor line of the plurality of conductor lines is a percentage of a line voltage for the corresponding conductor line and such that harmonic currents are reduced, wherein harmonic currents mitigation increases as a number of windings included in the at least three windings increases;

wherein one winding on one leg includes two sub-windings; and wherein each conductor line has a first end and a second end, the second end being tied in common to each other and the first end for receiving one phase of three phases of a power source and wherein the two sub-windings include a tap therebetween as an output of one of the three phases of the transformer.

2. The transformer of claim 1, wherein the percentage is within a range of 1 percent and 99 percent.

3. The transformer of claim 1, wherein the plurality of conductor lines comprises:

a first conductor line comprising a first plurality of windings;

a second conductor line comprising a second plurality of windings; and a third conductor line comprising a third plurality of windings.

4. The transformer of claim 3, wherein the first plurality of windings, the second plurality of windings, and the third plurality of windings each include five windings of at least two different phases that are consistent with a delta line configuration.

5. The transformer of claim 3, wherein the first plurality of windings, the second plurality of windings, and the third plurality of windings each include six windings of at least two different phases that are consistent with a delta line configuration.

6. The transformer of claim 3, wherein each winding of the first plurality of windings, the second plurality of windings, and the third plurality of windings has a number of turns selected based on a desired ratio of the line voltage to the phase voltage.

7. The transformer of claim 3, wherein the first plurality of windings, the second plurality of windings, and the third plurality of windings each include four windings of at least two different phases that are consistent with a wye line configuration.

8. The transformer of claim 3, wherein the first plurality of windings, the second plurality of windings, and the third plurality of windings each include six windings of at least two different phases that are consistent with a wye line configuration.

9. The transformer of claim 1, wherein the plurality of conductor lines are connected to each other at a neutral point.

10. The transformer of claim 1, wherein the core comprises:

a plurality of limbs, wherein the at least three windings of the corresponding conductor line are wound around at least two of the plurality of limbs.

11. A transformer comprising:

a core that includes a first leg, a second leg, and a third leg;

a first conductor line comprising a first plurality of windings that includes at least two windings of at least two phases between a neutral point and a first output connection point associated with the first conductor line;

a second conductor line comprising a second plurality of windings that includes at least two windings of at least two phases between the neutral point and a second output connection point associated with the second conductor line; and a third conductor line comprising a third plurality of windings that includes at least two windings of at least two phases between the neutral point and a third output connection point associated with the third conductor line, wherein harmonic currents mitigation increases as a number of windings included in the first plurality of windings, the second plurality of windings and the third plurality of windings increases;

wherein the first conductor line, the second conductor line, and the third conductor line are wound in a zigzag fashion around the first leg, the second leg, and the third leg such that each conductor line includes four windings, wherein one leg includes two windings, and two legs each include one winding of the four windings thereon, and such that each leg includes four windings thereon.

12. The transformer of claim 11, wherein the first conductor line, the second conductor line, and the third conductor line are connected to each other at the neutral point.

13. The transformer of claim 11, wherein each winding of the first conductor line, the second conductor line, and the third conductor line has a phase that is consistent with a delta line configuration.

14. The transformer of claim 11, wherein the transformer is a multi-phase autotransformer.

15. A transformer comprising:

a core that has a first leg, a second leg, and a third leg;

a first conductor line comprising a first plurality of windings that includes at least three windings;

a second conductor line comprising a second plurality of windings that includes at least three windings; and a third conductor line comprising a third plurality of windings that includes at least three windings, wherein the first plurality of windings, the second plurality of windings, and the third plurality of windings are wound around the core such that a phase of each winding of the first conductor line, the second conductor line, and the third conductor line is consistent with a wye line configuration, wherein harmonic currents mitigation increases as a number of windings included in the first plurality of windings, the second plurality of windings and the third plurality of windings increases;

wherein the first conductor line, the second conductor line, and the third conductor line are wound in a zigzag fashion around the first leg, the second leg, and the third leg such that each conductor line includes four windings, wherein one leg includes two windings, and two legs each include one winding of the four windings thereon, and such that each leg includes four windings thereon.

16. The transformer of claim 15, wherein the first plurality of windings, the second plurality of windings, and the third plurality of windings are wound around the core such that harmonic currents are reduced.

17. The transformer of claim 15, wherein a first output connection point, a second output connection point, and a third output connection point are out of phase by 120 degrees.

18. The transformer of claim 15, wherein the first plurality of windings form the first conductor line, the second plurality of windings form the second conductor line, and the third plurality of windings form the third conductor line in which the first conductor line, the second conductor line, and the third conductor line are connected to each other at a neutral point.

19. The transformer of claim 15, wherein the transformer is a multi-phase autotransformer and wherein a phase voltage at an output connection point associated with the first conductor line is determined by a number of turns in the first plurality of windings.

20. A multi-phase auto-transformer for improving power quality and mitigating electromagnetic interferences comprising:

a core that includes a first leg, a second leg, and a third leg; and a first conductor line, a second conductor line, and a third conductor line, each conductor line being wound in a zigzag fashion around the first leg, the second leg and the third leg such that each conductor line includes four windings, wherein one leg includes two windings and two legs include each one winding of the four windings thereon, and such that each leg includes four windings thereon.

21. The multi-phase auto-transformer of claim 20, wherein one winding on one leg includes two sub-windings.

22. The multi-phase auto-transformer of claim 21, wherein each conductor line has a first end and a second end, the second end being tied in common to each other and the first end for receiving one phase of three phases of a power source and wherein the two sub-windings include a tap therebetween as an output of one of the three phases of the multi-phase auto-transformer.

23. The multi-phase auto-transformer of claim 22, wherein each conductor line further includes a fifth winding such that two legs include each two windings and one leg includes one winding, each leg including five windings thereon.

24. The multi-phase auto-transformer of claim 23 including wye secondary and delta primary windings.

25. The multi-phase auto-transformer of claim 20, wherein:

the first conductor line includes a first winding wound on the first leg, a second winding wound on the third leg, a third winding wound on the second leg, and a fourth winding wound on the third leg;

the second conductor line includes a first winding wound on the second leg, a second winding wound on the first leg, a third winding wound on the third leg, and a fourth winding wound on the first leg; and the third conductor line includes a first winding wound on the third leg, a second winding wound on the second leg, a third winding wound on the first leg, and a fourth winding wound on the second leg.

26. The multi-phase auto-transformer of claim 25, wherein the third winding of the first conductor line, the second conductor line and the third conductor line includes each of two sub-windings.

27. The multi-phase auto-transformer of claim 26, wherein each conductor line has a first end and a second end, the second end being tied in common to each other and the first end for receiving one phase of three phases of a power source and wherein the two sub-windings include a tap therebetween as an output of one of the three phases of the multi-phase auto-transformer.

28. The multi-phase auto-transformer of claim 25, wherein each conductor line has a first end and a second end, the second end being tied in common to each other and the first end for receiving one phase of three phases of a power source and wherein a tap, located between the third winding and the fourth winding, serves as an output of one of the three phases of the multi-phase auto-transformer.

29. The multi-phase auto-transformer of claim 20 including wye secondary and wye primary windings.

* * * * *